United States Patent [19]

Guilford et al.

[11] Patent Number: 4,530,292

[45] Date of Patent: Jul. 23, 1985

[54] TREATMENT OF ACIDIC ORGANIC AND ALKALINE INORGANIC WASTES

[75] Inventors: Nigel G. H. Guilford, Toronto; Alan P. Cadotte, Oakville, both of Canada

[73] Assignee: Tricil Limited, Mississauga, Canada

[21] Appl. No.: 597,276

[22] Filed: Apr. 6, 1984

[51] Int. Cl.[3] ..... F23G 7/04

[52] U.S. Cl. ..... 110/346; 110/238

[58] Field of Search ..... 110/238, 237, 346, 215

[56] References Cited

U.S. PATENT DOCUMENTS 4,236,464 12/1980 Anderson et al. ..... 110/238

4,477,373 10/1984 Grantham et al. ..... 110/215 X

FOREIGN PATENT DOCUMENTS 2254255 11/1972 Fed. Rep. of Germany ..... 110/238

*Primary Examiner*—Edward G. Favors

*Attorney, Agent, or Firm*—Donald G. Ballantyne

[57] ABSTRACT

A method of simultaneously treating organic wastes and inorganic alkaline wastes is provided. The organic wastes are incinerated to generate an acid gas effluent. The acid gas effluent is reacted in a dryer reactor with a fluidized spray of inorganic alkaline waste which neutralizes the acid gas. The products of the reaction are substantially harmless gases, e.g., carbon dioxide and water vapor which are passed to atmosphere without scrubbing treatment, and fine particulate material which is collected for disposal. The cooling action of the alkaline spray reduces the volume and rate of flow of the combustion gases and permits use of a variety of solids collecting devices.

6 Claims, 1 Drawing Figure

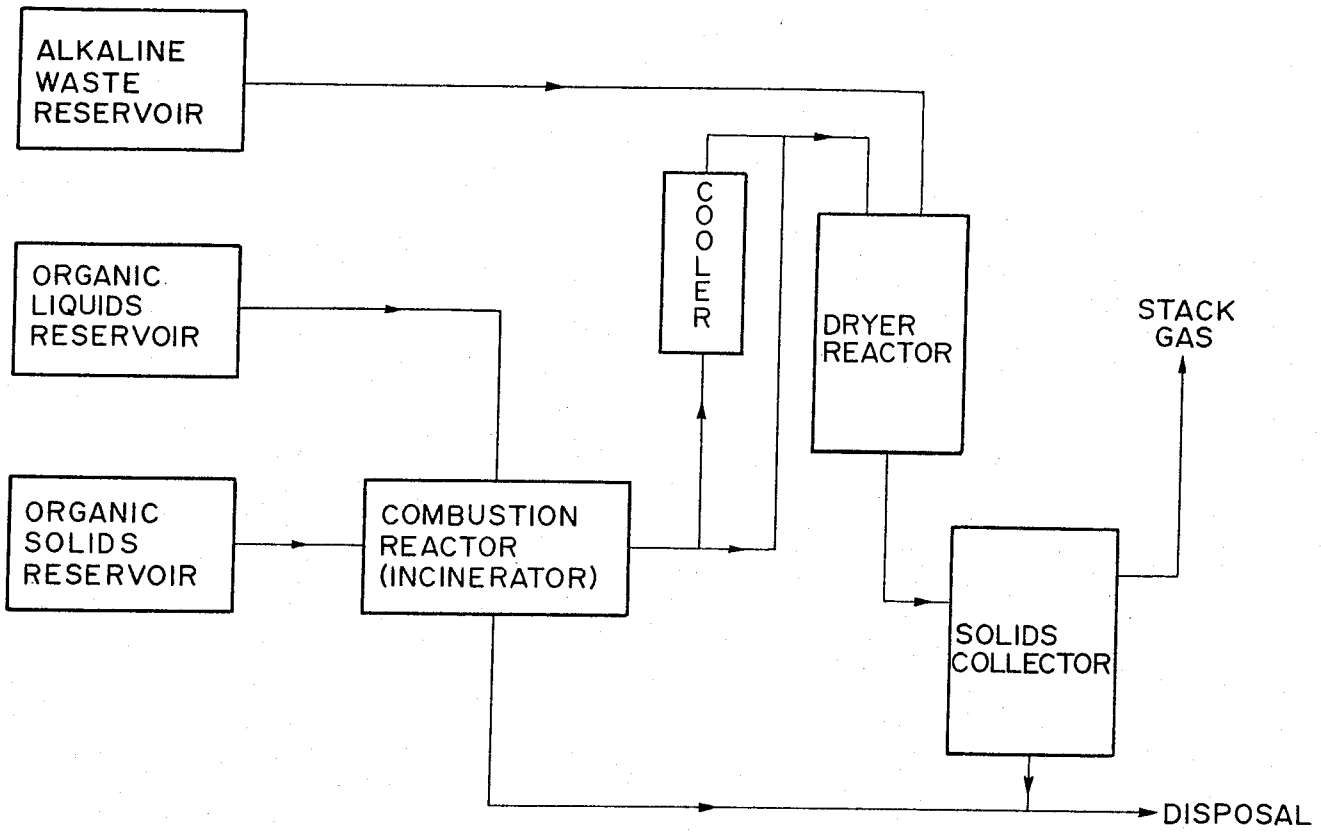
ALKALINE WASTE RESERVOIR
ORGANIC LIQUIDS RESERVOIR
ORGANIC SOLIDS RESERVOIR
COMBUSTION REACTOR (INCINERATOR)
COOLER
DRYER REACTOR
SOLIDS COLLECTOR
STACK GAS
DISPOSAL

TREATMENT OF ACIDIC ORGANIC AND ALKALINE INORGANIC WASTES

BACKGROUND OF THE INVENTION

Modern industrial processes create a wide range of unuseable waste products. In addition, large amounts of refuse of various kinds from domestic households and institutions are generated. All of these waste materials require non-polluting disposal or destruction. A number of disposal techniques are known but these techniques mainly have application to specific types of waste. Municipal refuse, for example, may be comminuted, separated into useful and waste components and the waste components destroyed by combustion, the ash residue being disposed of as landfill. Acid wastes from industrial processes may be neutralized with caustic and the neutral product disposed of in waterways. Alkaline wastes may be similarly neutralized and discharged into waterways. Toxic wastes and other hazardous sludges may be encapsulated into a structural material, for example, a fly ash/hydrated lime mixture and the resultant product disposed of in landfill. The problem faced by industry and by municipalities has been to devise waste treatment or waste disposal methods which produce non-polluting, small volume effluents, making use of facilities which are economic to construct and operate and which are capable of treating more than one type of waste product.

SUMMARY OF THE INVENTION

The present invention relates to the destruction of organic wastes by substantially complete combustion to produce an acid gas effluent and to treat the acid gas effluent with waste alkaline liquids or slurries. In particular, the present invention contemplates the complete destruction of combustible organic wastes without the release to atmosphere of any harmful by-product gases or vapors. In addition, the hot, gaseous products of combustion are employed to desiccate a flow of liquid or slurry alkaline waste.

A large number of organic wastes are produced in technologically advanced societies and include, for example, waste hydrocarbon oils and solvents from metal fabrication, expended hydraulic oils, oil refinery wastes, paints and plastics industry wastes and the like. Similarly, large amounts of alkaline liquid and slurry waste products are generated in metal descaling, lime treatment processes, sugar manufacture, textile treatment, chemical processes and the like. Typically, organic wastes are disposed of by combustion, the products of the combustion being discharged to the environment sometimes after appropriate cleansing or neutralization. Alkaline wastes are typically neutralized by acid and/or are solidified or admixed with flyash or similar material and disposed of in landfill. The present invention provides a method for simultaneously treating alkaline waste liquid or slurry and combustible organic waste, which method comprises the steps of:

(a) combusting organic wastes in a combustion reactor to produce a gaseous effluent containing molecules, which in the presence of water, produce strong acids, (b) directing a flow of dissolved or slurried aqueous alkaline waste to a dryer reactor, (c) directing the said gaseous effluent to the said dryer reactor wherein the said acidic gaseous effluent is caused to react with the said alkaline waste to precipitate and simultaneously desiccate the said alkaline waste, while the said acidic gaseous effluent is substantially neutralized, (d) directing the said precipitate and the said neutralized acid gas effluent from the said dryer reactor to a solids collection station, and (e) separating said neutralized gas from the said precipitate for discharge to the atmosphere while the precipitate is collected for disposal.

DESCRIPTION OF THE DRAWING

The drawing is a block flow diagram showing the method of the invention.

DESCRIPTION OF THE PREFERRED EMBODIMENT

The method of the invention is suitable for treatment of substantially all organic matter whether solid or liquid. Solid organic wastes such as plastic material, resins, fibres, and the like may require pre-combustion preparation such as by comminution by well-known methods. Lean liquid organics not having sufficient fuel value for self-sustained combustion require the addition of a secondary fuel such as fuel oil or they may be blended with richer organic liquid wastes. The alkaline waste capable of treatment by the method of the invention may require screening, water dilution or agitation prior to gaseous neutralization. Both types of waste, prior to treatment are usefully held in storage reservoirs and their pre-treatment composition determined by chemical/physical analyses.

The method of the invention is diagrammatically shown in the drawing. An alkaline waste which may comprise, inter alia, high calcium lime, magnesia, sodium hydroxide and the like in the form of an aqueous solution or slurry is held in an alkaline waste reservoir from which it can be delivered by pump (not shown) to the dryer reactor. Organic liquid waste which may comprise, for example, oil refinery discharge, is held in a liquids reservoir from which it can be delivered by pump (not shown) to a combustion reactor or incinerator. Organic solid waste comprising, for example, plastics residue, is held in a reservoir for delivery to the combustion reactor by, for example, mechanical or pneumatic conveyor (not shown). Upon combustion, the organic waste is converted into an acidic gaseous mixture containing, for example, hydrogen chloride, sulfur dioxide, nitric oxides, carbon dioxide, nitrogen, oxygen, water vapor plus trace amounts of other gases, and some aerosols. Some small amounts of additional solids, mainly incombustible mineral ash, may also be produced. The hot gases from the combustion reactor are preferably, but not essentially, cooled to a temperature of about 450° C. in a cooler before being introduced into the dryer reactor where they are brought into contact with the incoming flow of alkaline waste. Care must be taken to maintain the temperature of the gas above its dew point, that is, the temperature at which the components of the gas are converted to a vapor or liquid. The rate of flow of alkaline waste liquid or slurry to the dryer reactor is based upon its alkaline content and is maintained so that the alkaline component of the waste liquid is in stoichiometric excess of the acid component of the combustion gases. The hot, acidic combustion gases react with the fluid alkaline waste within the dryer reactor to produce a salt precipitate and water as follows, for example:

$$NaOH + HCl \rightarrow NaCl + HOH$$

or $$Mg(OH_2) + H_2SO_4 \rightarrow MgSO_4 + 2HOH$$

Simultaneously, the aqueous component of the alkaline waste is driven off as water vapor. In the dryer, the combustion gases are effectively cooled during the reaction with the liquid or slurry alkaline waste resulting in a substantial reduction in gas volume with a consequent reduction in the rate of flow of the effluent gases. Additionally, the lowering of the temperature of the gaseous dryer effluent permits the use of a variety of solids collecting or filtering devices which would otherwise not be possible with gases at near combustion temperatures. The solid products of the reaction which form when the excess water is evaporated within the dryer reactor consist of a mixture of metal salts, e.g. chlorides, sulfates, carbonates and the like, in the form of small particles or dust. The heavier solid products precipitate to the bottom of the dryer reactor and are removed for subsequent disposal. The lighter solid products are carried by the unreacted combustion gases, e.g., carbon dioxide, nitrogen, oxygen, water vapor, to a solids collector such as a baghouse, where the solids are removed from the gas stream by filtration, centrifuge or cyclone or similar means and thereafter packaged or compressed for landfill disposal. The harmless gases are vented to atmosphere.

The apparatus used to practice the method of the invention is substantially conventional apparatus such as is used in standard chemical or engineering processes. The combustion reactor or incinerator may be, for example, a rotary kiln, for organic sludges or a semi-suspension or mass-burning refuse incincerator, etc. The combustion gas cooler, when used, can be for example, an economizer or an air-to-air heat exchanger. The dryer reactor can be a spray dryer of the high-pressure nozzle or rotating disc atomizer type. The solids collection apparatus is preferably a baghouse type collector, for example, a pulse-jet type. The various reservoirs, piping, pumps, ducts, fans, stacks and auxiliary apparatus are conventional in design or modified as necessary and the material of construction is selected for the particular process conditions encountered.

EXAMPLE

A waste treatment facility of the present invention was utilized to process liquid organic wastes (mixed oil refinery waste) and alkaline wastes (lime treatment process waste liquor) as follows. Organic waste was fed by pump to a stationary incinerator at a rate of 250 liters per minute where it was burned to produce an exhaust gas effluent at 700° C. The exhaust gas was cooled to 450° C. in an air-to-air heat exchanger and directed into a spray dryer reactor. Approximately 85.1 liters per minute of alkaline waste liquor was sprayed into the dryer reactor where it reacted with and cooled the combustion gas effluent to 200° C. Greater than 80% of HCl and 50% of $SO_2$ were removed from the gas effluent in the spray dryer. The substantially neutralized gas effluent was directed to a baghouse for particulate removal. The particulate material recovered from the spray dryer and baghouse amounted to 20.1 kilograms per minute of operation or about 38.6 cubic meters per day at a density of 750 kilograms/per meter$^3$. On an annual basis, 142,000 cubic meters per year of combined organic and alkaline waste is reduced in volume by 91.3% to 12,300 meters$^3$ of dry particulate, suitable for landfill.

We claim:

1. A method for simultaneously treating acidic combustible organic waste and alkaline inorganic waste liquor comprising the steps of:

(a) combusting organic wastes in a combustion reactor to produce a hot, acidic gaseous effluent, (b) directing a flow of liquid alkaline waste to a spray dryer reactor, (c) directing the said hot, acidic gaseous effluent to the said spray dryer reactor wherein the said gaseous effluent is caused to react with the said alkaline waste to precipitate and simultaneously desiccate the said alkaline waste while the said gaseous effluent is substantially neutralized, (d) directing the said desiccated precipitate and the said neutralized gaseous effluent from said spray dryer reactor to a solids collection station, and (e) separating said neutralized gaseous effluent from said precipitate for discharge to atmosphere while the said precipitate is collected for disposal.

2. A method as claimed in claim 1 also comprising the step of cooling the said hot acidic gaseous effluent prior to the side dryer reactor.

3. A method as claimed in claim 1 also comprising the step of adding to the said organic waste a readily combustible liquid fuel.

4. A method as claimed in claim 1 wherein the said alkaline inorganic waste liquor is in the form of a slurry.

5. An apparatus for the simultaneous treatment of combustible organic waste and alkaline inorganic liquid waste comprising:

(a) means for storage of untreated combustible organic waste, (b) means for storage of untreated alkaline inorganic waste liquor, (c) a combustion reactor, (d) a spray dryer reactor, (e) means for transferring said stored untreated organic waste to said combustion reactor, (f) means for transferring gaseous products of combustion from the said combustion reactor to the said spray dryer, (g) means for transferring said stored alkaline waste liquor to said spray dryer for contact and chemical reaction with the said gaseous combustion products to produce a cooled, reduced volume and neutralized gaseous effluent and a particulate residue, and (h) means for separating said particulate residue from the said neutralized gaseous effluent.

6. An apparatus as claimed in claim 5 also comprising means for cooling the said combustion reactor gaseous products prior to transfer to said spray dryer reactor.

* * * * *